US010352004B2

(12) United States Patent
Lourenço Serro

(10) Patent No.: US 10,352,004 B2
(45) Date of Patent: Jul. 16, 2019

(54) LOAD TRANSMISSION DEVICE

(71) Applicant: Afonso Moreira Serro, Lisbon (PT)

(72) Inventor: Manuel Filipe Lourenço Serro, Lisbon (PT)

(73) Assignee: MOREIRA SERRO, AFONSO, Lisboa (PT)

( * ) Notice: Subject to any disclaimer, the term of this patent is extended or adjusted under 35 U.S.C. 154(b) by 0 days.

(21) Appl. No.: 15/314,108

(22) PCT Filed: May 26, 2015

(86) PCT No.: PCT/PT2015/000025
§ 371 (c)(1),
(2) Date: Nov. 28, 2016

(87) PCT Pub. No.: WO2015/183112
PCT Pub. Date: Dec. 3, 2015

(65) Prior Publication Data

US 2017/0198443 A1 Jul. 13, 2017

(30) Foreign Application Priority Data

May 28, 2014 (PT) ..... 107664

(51) Int. Cl.
*E01C 11/02* (2006.01)
*E01C 11/14* (2006.01)
(Continued)

(52) U.S. Cl.
CPC ..... *E01C 11/14* (2013.01); *E01C 5/005* (2013.01); *E04C 5/00* (2013.01); *E01C 5/06* (2013.01); *E01C 2201/12* (2013.01); *E04B 5/023* (2013.01); *E04C 5/18* (2013.01); *E04C 5/205* (2013.01)

(58) Field of Classification Search
CPC ..... E01C 11/14
USPC ..... 404/47, 51, 52, 58, 60; 52/414, 415, 52/649.5
See application file for complete search history.

(56) References Cited

U.S. PATENT DOCUMENTS 780,936 A * 1/1905 Carter
2,203,078 A * 6/1940 Carter ..... E01C 11/14 404/47
(Continued)

FOREIGN PATENT DOCUMENTS

AT 11418 U1 10/2010
CN 1800540 A 7/2006
(Continued)

*Primary Examiner* — Thomas B Will
*Assistant Examiner* — Katherine J Chu
(74) *Attorney, Agent, or Firm* — Mark M. Friedman

(57) ABSTRACT

A telescopic bar for load transmission which, if anchored in concrete slabs, creates a support between them, forming semi-rigid joints, and prevents differential settlement of the slabs, by enabling rotation in the vertical direction about a joint axis. The telescopic bar transmits a load from one slab to an adjacent slab, ensures perfect leveling of the slab surfaces, and enables removal and reuse of the slab at a later time. The telescopic bar may be used for constructing floors of easily manufactured prefabricated materials, and creates a new paradigm for the construction of roads, seaports, airports, railways, industrial areas, etc.

3 Claims, 3 Drawing Sheets

(51) Int. Cl.

| | |
|---|---|
| ***E01C 5/00*** | (2006.01) |
| ***E04C 5/00*** | (2006.01) |
| *E01C 5/06* | (2006.01) |
| *E04B 5/02* | (2006.01) |
| *E04C 5/18* | (2006.01) |
| *E04C 5/20* | (2006.01) |

(56) References Cited

U.S. PATENT DOCUMENTS 2,508,443 A * 5/1950 Carter ..... E01C 11/106 404/60
2,548,214 A * 4/1951 Heltzel ..... E01C 19/504 403/186
3,369,334 A * 2/1968 Berg ..... E04B 1/06 52/223.13
3,648,423 A * 3/1972 Cole ..... E04B 1/6815 404/52
3,797,952 A * 3/1974 Pommerening ..... E01D 19/062 404/52
4,374,634 A * 2/1983 Ahl ..... E04G 11/22 425/65
4,648,739 A * 3/1987 Thomsen ..... E01C 11/227 404/2
5,078,529 A * 1/1992 Moulton ..... E04B 1/6804 403/24
6,022,169 A * 2/2000 Kim ..... E01D 19/062 14/73.1
6,058,672 A * 5/2000 McClellan ..... E04B 1/04 52/309.12
6,065,263 A * 5/2000 Taguchi ..... E04B 5/023 403/305
7,334,963 B2 * 2/2008 Costa ..... E01C 7/147 404/49
7,409,691 B2 * 8/2008 Bendapudi ..... G06F 9/547 719/319
8,209,933 B2 * 7/2012 Law ..... E01C 11/14 404/47

FOREIGN PATENT DOCUMENTS

CN 203008388 U 6/2013
CN 203401620 U 1/2014
DE 3317858 A1 * 11/1984 ..... E04B 2/94
WO WO2009030940 A2 3/2009
WO WO-2010002285 A2 * 1/2010 ..... E02D 27/01

* cited by examiner

LOAD TRANSMISSION DEVICE

FIELD OF THE INVENTION

The scope of the present invention is the construction and public works, namely construction with concrete and specifically construction of roads and highways, ports, airports, railways and industrial areas.

TECHNICAL BACKGROUND OF THE INVENTION

The following patent documents were identified through a research on the prior art in the field of the invention:

(D1) The CN 1800540 A—D1 describes a hollow reinforced concrete slab comprising hollow elements of reinforced concrete. The elements are concreted "in situ" and reinforced with a concrete rib. The hollow elements comprise a formwork cavity. The invention can be applied to various solutions of molded and reinforced concrete, such as roofs of buildings, foundation slabs, walls and bridges;

(D2) CN 203401620 U—D2 is a utility model which discloses a connector for steel bars and is designed with the objective of solving the problems associated with the reinforcing steel bars, which may include the use of electrical and mechanical equipment, before or during the construction, to connect the reinforcing threaded steel construction, to connect the reinforcing threaded steel bars used in construction. The invention comprises a casing tube, internal screw threads, and fixing screws and is characterized in that the internal threads are embedded in the inner wall of the casing tube; and in that it includes a plurality of fixing screws arranged in the location corresponding to the internal screw threads;

(D3) CN 203008388 U—D3 discloses a steel support bar fixed in a reinforced concrete slab casted "in situ". It comprises a sleeve tube, an end cap, a support rod, a block, a locking bar, a nut and a locking latch, in which the lower part of the sleeve tube is toothed while the lower middle part of the sleeve tube is closed.

The present invention relates to telescopic bars for load transmission anchored and cast in cement concrete slabs, which allow the transmission of loads from a slab to the adjacent slabs, and not only ensure the transmission of said loads but, simultaneously, also prevent the differential settlement of those slabs.

The telescopic function of the bar which allows its support between slabs created a new possibility of obtaining prefabricated floorings easy to manufacture and assemble in situ, creating a new concept in the construction of roads, ports, airports, railways, industrial areas, etc., which distinguishes the present invention from the closest state of the art.

Additionally, the possibility of obtaining concrete roads with these telescopic bars, and the fact that the constituent slabs can be prefabricated, remarkably reduces the environmental impact since the constituent elements do not release pollutants, neither in the manufacture nor in the application and use.

Once the telescopic bars for load transmission are alternately arranged and anchored in the base of the slabs along the backrest joints, the bending stresses in the upper edge of said slabs decrease and a rotation about its axis in the vertical direction of said joints is allowed.

Thus, any unevenness in the upper joint edge formed by the separation of the slabs can be eliminable, whether these slabs are pre-molded or not.

Additionally to the above, it should be noted that if the foundations suffer differential settlements due to its elastic function or by erosion of the same, these concrete slabs will be able to follow these movements, ensuring the leveling in the axis of the backrest joints, and allowing the slabs to rest entirety on the foundation, thus being subjected to compressive stresses and reducing the stresses generated by the flexion/traction forces caused by the transmission of the loads.

As can be seen, these bars which allow prefabrication of concrete slabs for ground floors over elastic foundations also allow a further possibility consisting in obtaining over-elevations at the outer radius of curves, which are so far impossible by techniques of in situ concreting due to the sag of the concrete thus creating shrinkage cracks and putting slabs out of use.

This possibility results from the manufacture of slabs in molds with predefined curvature, thus maintaining a perfect planimetry even when the over-elevation bend of the curves is marked.

The use of telescopic bars, since they allow prefabrication of concrete slabs, also allow obtaining curves with constant radius after topographical information, increasing the safety and convenience of road traffic.

Thus, we can conclude that these two advantages of over-elevations of the outer radius of the curve and constant radius will save countless lives in the future and increase the driving speed—thus increasing savings in the transport of commodities, people and goods and increasing savings in the fuel consumption.

The innovation of the invention consists in the ability of creating a flexible load transmission support, after the execution or placement of prefabricated slabs of cement concrete, for building ground floors in highways, roads, airports, ports and industrial areas.

This possibility of having telescopic bars which extend or are retracted underneath contiguous slabs, not only allows to place the slabs as well as to remove them whenever necessary (repair the foundations or placing tubes for underpasses, etc.), thus allowing obtaining removable slabs.

These removable slabs allow placement (mounting) through the use of cranes over any land or deformable material (EPS type, etc,) in any kind of weather conditions (freezing, rain, sun, wind, day, night, etc.).

In summary, the telescopic bars object of the present invention allow the pre molding of slabs with numerous technical and economic advantages compared to the prior art, such as:

a) Speed of construction:
   - i. Placement of the pre molded slabs using a crane. Manpower of this operation=3 men;
   - ii. Placing in work shifts, since the slabs are already prefabricated, allowing a continuous placing without interruption;
   - iii. Placing with any atmospheric weather (rain, freezing and defrosting, positive and negative temperatures, sun, fog, etc.);
   - iv. Immediate use;
   - v. Eliminating manpower and heavy equipment for in situ construction;

b) Economy
   - i. Absence of manpower to build in situ;
   - ii. No heavy equipment;
   - iii. Immediate use;
   - iv. Useful life span exceeding 50 years;

c) Foundations
   i. Soil with low support, less than one kilogram/cm$^3$
   ii. Expansive soils
   iii. Artificial soils EPS, stabilized soils (cement, lime, etc.)
d) Quality of the concrete
   i. Concrete of high resistance and easy control in manufacturing;
   ii. Concrete of high mechanical wear strength with optimized prefabricated ribbing;
   iii. Concrete manufactured and molded under optimum conditions of temperature and humidity;
e) Levelling of slabs and planimetry: optimized to 0 mm;
f) Applications:
   i. Curves with high over-elevations with the required angle;
   ii. Curves with constant radius;
   iii. Large tilt angles (up and down);
   iv. Coverage of embankments;
   v. Ideal for construction of railways, roads and highways, either in urban or open fields, ports and airports and industrial areas, etc.;
g) Adherence and security controlled in project and in factory: ribbing with optimized prefabrication;
h) Environmental impact: The possibility of obtaining concrete roads with these telescopic bars, and the fact that the constituents can be prefabricated slabs, remarkably reduces the environmental impact since the constituent elements do not release pollutants neither in the manufacture, nor in the placement and use.

BRIEF DESCRIPTION OF THE DRAWINGS

The description that follows is based on the appended figures which represent, without any limiting characteristic.

DETAILED DESCRIPTION OF THE INVENTION

Figure 1:
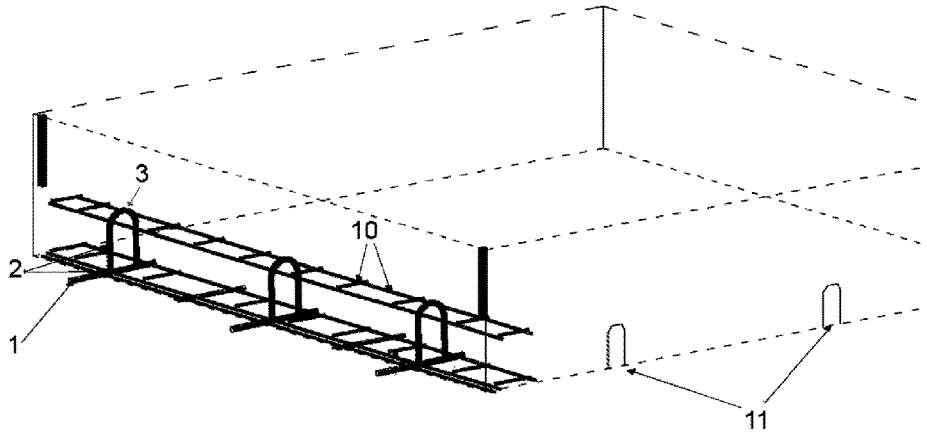
FIG. 1—A schematic perspective view of the telescopic bar object of the invention in its essential embodiment, i.e. the first described below, in which the telescopic bar for load transmission (1) is represented with a rack (4), which runs inside a sheath (2) and an anchoring arc (3), with lower and upper alignment and strengthening armatures (10) and two openings with underpass of the slabs (11).
Figure 2:
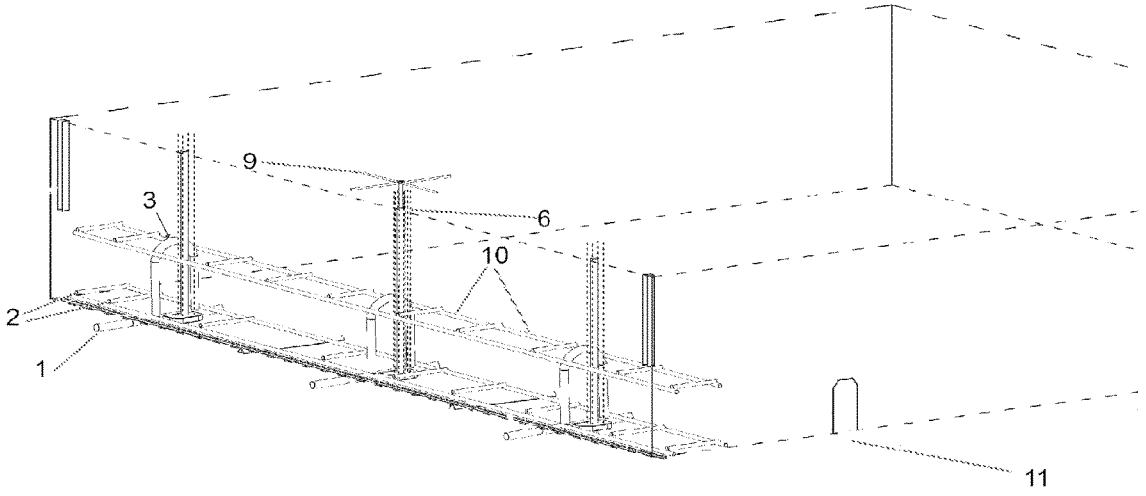
FIG. 2—A schematic perspective view of a second embodiment of the invention in which the telescopic transmission bar (1) is represented, which runs inside a sheath (2) and an anchoring arc (3), with lower and upper alignment and strengthening armatures (10), a key for rotation (9) of the pinion, which will extend the telescopic bar (1), an access chamber (6) to the pinion, two openings (11) with underpass of the slabs for placement of lifting and mounting hooks, vertical ribs/guides for aligning the slabs at the assembly stage.
Figure 3:
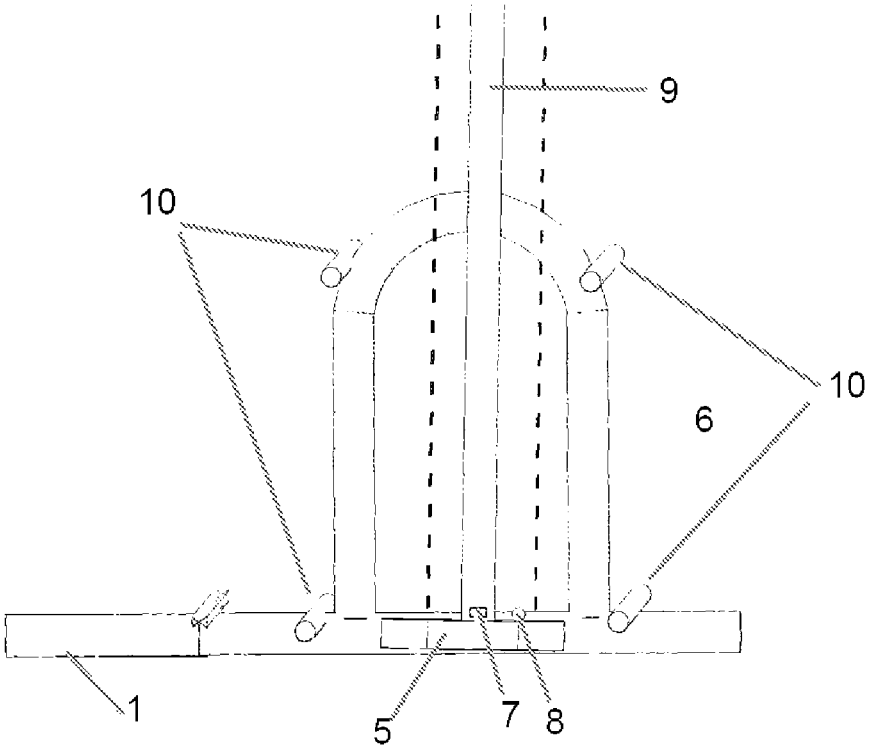
FIG. 3—An elevation view of the telescopic bar for load transmission of a second embodiment of the invention, in which all the same components of FIG. 2 are shown, but with the pinion (5) being visible.
Figure 4:
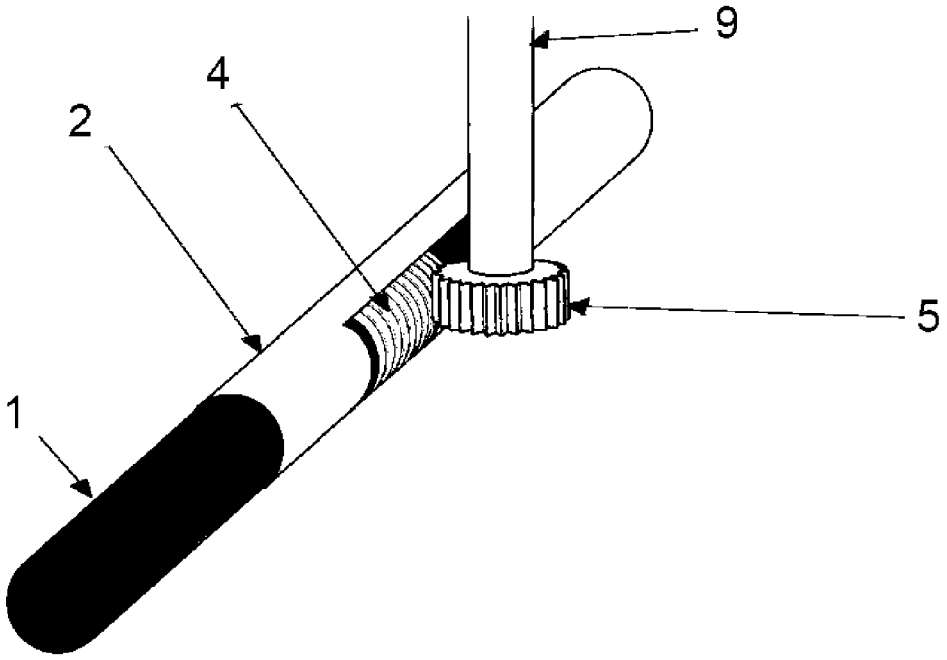
FIG. 4—A perspective view of the telescopic bar of a second embodiment of the invention, in which all the same components of FIG. 3 are shown, but with the rack (4) being visible.

As can be seen in the figures, the bar for load transmission (1) is provided with telescopic movement inside a sheath (2). This bar (1) is provided with an anchoring arc or bar (3) which, as the name implies, is fixed to the slab represented as a dashed line.

The telescopic function of the transmission bars (1) is ensured by a system which transforms the rotary motion of a part in a rectilinear motion of another part. In this particular case, it is used a system comprising a rack and pinion or an endless screw and sector system. In the illustrated case, the pinion (5) at the end of a rotation key (9), actionable from the surface of the slab, moves the rack (4) in the surface of the telescopic bar. The key (9) is inserted in an access chamber (6). The pinion (5) inserted in a box can be adjusted through an adjusting nut (7) and locked by means of a locking pin (8). This transmission system allows moving the bar from back to front, being in a sheath already pre anchored in the contiguous pre molded slab, thereby creating a semi-continuous support between said slabs.

The pinion (5) can be visited from the surface of the slab through a negative in the form of cylindrical tube, coincident with the nut of the gear (pinion) and with the safety pin, for introduction of a wrench which will allow the displacement of said bar or, if rotated in the opposite direction, the retraction of the same.

This access will be filled with a material easily removable a posteriori (EPS, sponge, etc.) and properly sealed at the slab surface in order to prevent the passage of liquids and diverse dirt, which in the future would prevent the proper functioning of the pinion or which would damage it.

As can be understood from the previous description, the slab comprises a channel for insertion of the acceptance sheath (2) functioning as the female part of the transmission system, while the bar (1) functions as the male part of the same system. These channels for the insertion of the sheaths (2) are drawn in the bottom of the slab. Said slab further comprises upper and lower alignment and strengthening armatures (10), vertical ribs/guides for alignment during assembly of the various slabs, and two openings (11) with underpass of the slabs for placing lifting hooks and mounting the same.

The acceptance sheaths (2) (female part) may be lined with a durable material (carbon fiber, etc.) and still eliminating any noise which may result from the contact of an iron bar against an iron sheath.

Once the telescopic bars for load transmission (1) are alternately disposed and anchored in the base of the slabs along the backrest joints, the bending stresses in the upper edge of said slabs decrease and a rotation about its axis in the vertical direction of said joints is allowed.

Thus, any unevenness in the upper joint edge formed by the separation of the slabs can be eliminable, either these slabs are pre molded or not, as aforementioned. The shear stress in the telescopic bars will be verified in order to not introduce flexion traction forces higher than the concrete slab resistance when it is subject to load.

Preferred Ways of Carrying out the Invention

In a first preferred embodiment of the invention, the fabrication of the slabs in bend molds is pre-defined, i.e. a perfect planimetry is maintained even when the over-elevation bend of the curves is marked. In summary, in a first embodiment the bar (1) is provided with an anchoring arc or bar (3) with fixed curvature.

In a second preferred embodiment of the invention, the telescopic bars for load transmission (1) are constituted by a single piece which is anchored to the slab in the same position and alignment, and which accepts the acceptance sheaths of the adjoining slab, maintaining the same type of function as the telescopic bar.

In a third preferred embodiment of the invention, the bars (1) may rotate about an axis with a limited travel, in which a bar already pre fixed in an acceptance slab and the extension of the sane is inserted in a sheath which is screwed to a rigid base, anchored in the adjoining slab. This bar (1) is placed on top of the slab and allows the construction of slabs of variable length and width, ensuring the concave and convex connections of constant radius between two planes with variable angle. Thus, the concordances between ascent and descent, respectively for higher and lower planes, allows for the in situ placement of small segments of pre molded slabs, joined together by these bars in the axis of the joints, avoiding the sophisticated fabrication of molds with side diaphragm and bases of flexible material, only possible in sophisticated industrial facilities, thus solving with the same efficacy the mentioned concordances between different planes.

In a fourth preferred embodiment of the invention, the bars (1) are executed in a similar way as the third embodiment, however they have larger dimensions and are placed laterally along the thickness of the slab, where access to the top of the slab is difficult or does not allow the filling of the attachment zone of the acceptance sheaths, due to the excessive abrasion.

Lisbon, May 26, 2015

The invention claimed is:

1. A telescopic bar (1) anchored in slabs, that creates a support between said slabs and forms semi-rigid joints, said telescopic bar (1) comprising a sheath (2), an anchoring arc (3) fixed to said sheath (2), a rack (4) fixed to a surface of said telescopic bar (1), a rotational key (9) inserted into an access chamber (6), alignment and strengthening armatures (10), and a transmission system from rotary motion into rectilinear motion, which moves said rack (4) and which is actionable from a slab surface by turning said rotational key (9), said transmission system further comprising a pinion (5) and an adjusting nut (7);

wherein said telescopic bar (1) transmits a load between said slabs and prevents differential settlement of said slabs.

2. The telescopic bar (1) according to claim 1, wherein said access chamber (6) is filled with a flexible material and is sealed at said slab surface.

3. The telescopic bar (1) according to claim 1 wherein said slabs are prefabricated concrete slabs.

* * * * *